US010179956B2

(12) United States Patent
Murakami et al.

(10) Patent No.: US 10,179,956 B2
(45) Date of Patent: Jan. 15, 2019

(54) ANODIC OXIDE COATING, TREATMENT METHOD THEREFOR, AND PISTON FOR INTERNAL COMBUSTION ENGINE

(71) Applicant: SUZUKI MOTOR CORPORATION, Shizuoka-ken (JP)

(72) Inventors: Haruhiko Murakami, Shizuoka-ken (JP); Masahiro Fujita, Shizuoka-ken (JP)

(73) Assignee: SUZUKI MOTOR CORPORATION, Shizuoka-Ken (JP)

( * ) Notice: Subject to any disclaimer, the term of this patent is extended or adjusted under 35 U.S.C. 154(b) by 260 days.

(21) Appl. No.: 14/776,468

(22) PCT Filed: Mar. 26, 2015

(86) PCT No.: PCT/JP2015/059366
§ 371 (c)(1),
(2) Date: Sep. 14, 2015

(87) PCT Pub. No.: WO2015/147163
PCT Pub. Date: Oct. 1, 2015

(65) Prior Publication Data

US 2016/0122894 A1 May 5, 2016

(30) Foreign Application Priority Data

Mar. 27, 2014 (JP) ..... 2014-065955
Dec. 15, 2014 (JP) ..... 2014-253026

(51) Int. Cl.
*C25D 11/12* (2006.01)
*C25D 7/04* (2006.01)
(Continued)

(52) U.S. Cl.
CPC ..... *C25D 11/12* (2013.01); *C25D 7/04* (2013.01); *C25D 11/024* (2013.01);
(Continued)

(58) Field of Classification Search
None
See application file for complete search history.

(56) References Cited

U.S. PATENT DOCUMENTS 3,666,638 A 5/1972 Harris et al.
4,166,776 A 9/1979 Lefebvre et al.
(Continued)

FOREIGN PATENT DOCUMENTS

CN 1221205 A 6/1999
CN 1225501 A 8/1999
(Continued)

OTHER PUBLICATIONS

International Search Report for PCT/JP2015/059366, dated Jun. 23, 2015.
(Continued)

*Primary Examiner* — Vera Katz
(74) *Attorney, Agent, or Firm* — Alston & Bird LLP

(57) ABSTRACT

Provided are an anodic oxide coating for an aluminum-based material, a treatment method therefor, and a piston for an internal combustion engine, the anodic oxide coating having both high heat insulation properties and high corrosion resistance, high durability and high impact resistance, and high water-repellent and oil-repellent functions. The treatment method includes the steps of: forming a second anodic oxide coating 2*b* by application of AC-DC superimposition electrolysis to an aluminum-based material 1; and, after the step, forming a first anodic oxide coating 2*a* by application of direct-current electrolysis to the aluminum-based material 1, wherein the second anodic oxide coating 2*b* is formed on the first anodic oxide coating 2*a*.

10 Claims, 4 Drawing Sheets

(51) Int. Cl.

| | |
|---|---|
| ***C25D 11/24*** | (2006.01) |
| ***F02F 3/10*** | (2006.01) |
| ***C25D 11/02*** | (2006.01) |
| *F02F 3/12* | (2006.01) |

(52) U.S. Cl.
CPC ..... *C25D 11/246* (2013.01); *F02F 3/10* (2013.01); *F02F 3/12* (2013.01)

(56) References Cited

U.S. PATENT DOCUMENTS

| | | | | |
|---|---|---|---|---|
| 4,278,737 | A | 7/1981 | Creffield et al. | |
| 4,440,069 | A | 4/1984 | Holtzberg et al. | |
| 4,566,952 | A | 1/1986 | Sprintschnik et al. | |
| 4,606,796 | A * | 8/1986 | Hanazima | C25D 11/18 205/174 |
| 4,687,551 | A * | 8/1987 | Furneaux | B01D 67/0065 205/50 |
| 5,411,607 | A | 5/1995 | Basaly et al. | |
| 5,891,269 | A | 4/1999 | Koerner et al. | |
| 5,980,722 | A | 11/1999 | Kuroda et al. | |
| 6,027,629 | A * | 2/2000 | Hisamoto | B01J 3/006 205/172 |
| 6,258,463 | B1 | 7/2001 | Corridan | |
| 6,407,367 | B1 | 6/2002 | Ito et al. | |
| 2002/0153595 | A1 | 10/2002 | Tayanaka | |
| 2006/0037866 | A1 | 2/2006 | Yamamoto et al. | |
| 2008/0149897 | A1 | 6/2008 | Burkle | |
| 2008/0213618 | A1* | 9/2008 | Critchlow | C25D 11/08 428/613 |
| 2009/0236228 | A1* | 9/2009 | Yamamoto | C25D 11/04 205/83 |
| 2009/0298680 | A1 | 12/2009 | Huang | |
| 2010/0219079 | A1* | 9/2010 | Routkevitch | B01D 53/228 205/175 |
| 2012/0039066 | A1 | 2/2012 | Hatanaka et al. | |
| 2012/0042859 | A1 | 2/2012 | Sakai | |
| 2012/0217167 | A1 | 8/2012 | Tanaka et al. | |
| 2013/0146041 | A1 | 6/2013 | Hijii et al. | |
| 2015/0135969 | A1 | 5/2015 | Rubio et al. | |
| 2016/0068986 | A1* | 3/2016 | Murakami | C25D 11/18 205/50 |
| 2016/0138179 | A1* | 5/2016 | Murakami | C25D 11/246 205/50 |

FOREIGN PATENT DOCUMENTS

| | | | |
|---|---|---|---|
| CN | 101591745 | A | 12/2009 |
| CN | 102376861 | A | 3/2012 |
| CN | 102705100 | A | 10/2012 |
| DE | 27 49 227 | C3 | 5/1978 |
| DE | 197 48 926 | A1 | 5/1998 |
| EP | 0 121 880 | B1 | 10/1984 |
| JP | S56-75592 | A | 6/1981 |
| JP | S60-134198 | | 7/1985 |
| JP | H0327797 | | 12/1991 |
| JP | H0681195 | | 3/1994 |
| JP | H111795 | A | 1/1999 |
| JP | H11509579 | | 8/1999 |
| JP | 2000109996 | | 4/2000 |
| JP | 2001-158995 | A | 6/2001 |
| JP | 2002-249895 | A | 9/2002 |
| JP | 2003003296 | | 1/2003 |
| JP | 2005008948 | | 1/2005 |
| JP | 2006083467 | | 3/2006 |
| JP | 2009235539 | | 10/2009 |
| JP | 2009 256778 | A | 11/2009 |
| JP | 2010 077532 | | 4/2010 |
| JP | 2010249008 | | 11/2010 |
| JP | 2012046784 | | 3/2012 |
| JP | 2014173128 | | 9/2014 |
| WO | WO 2013/171408 | | 11/2013 |

OTHER PUBLICATIONS

Office Action for German Application No. 11 2015 000 039.9 dated Feb. 7, 2017.
Office Action for Chinese Application No. 201580001136.7 dated Dec. 29, 2016.
Written Opinion for International Application No. PCT/JP2015/059366 dated Jun. 30, 2015.
International Search Report and Written Opinion for Application No. PCT/2015/059364 dated Jun. 30, 2015.
International Search Report and Written Opinion for Application No. PCT/JP2015/059367 dated Jun. 30, 2015.
Extended European Search Report for corresponding European Application No. 15722916.2 dated Dec. 8, 2015, 6 pages.
International Search Report and Written Opinion for corresponding International Application No. PCT/JP2015/055400, dated May 26, 2015 with English Translation, 18 pages.
Office Action for European Application No. 15722916.2 dated Sep. 7, 2016, 3 pages.
Office Action for U.S. Appl. No. 14/442,593 dated Feb. 14, 2018.
Office Action for U.S. Appl. No. 14/442,593 dated Sep. 13, 2017.
Office Action for U.S. Appl. No. 14/776,472 dated Mar. 9, 2018.
Ono et al., *Sealing Mechanism of Anodic Porous Oxide Films Formed on Aluminum in Lithium Hydroxide Solution*, The Japan Institute of Light Metals (Sep. 2010) 1463-1468.
Office Action for U.S. Appl. No. 14/776,472 dated Sep. 21, 2018.

* cited by examiner

ANODIC OXIDE COATING, TREATMENT METHOD THEREFOR, AND PISTON FOR INTERNAL COMBUSTION ENGINE

CROSS-REFERENCE TO RELATED APPLICATIONS

This application is a national stage application filed under 35 U.S.C. 371 of International Application No. PCT/JP2015/059366, filed Mar. 26, 2015, which claims priority from Japanese Patent Application No. 2014-065955, filed Mar. 27, 2014, and Japanese Patent Application No. 2014-253026, filed Dec. 15, 2014, each of which is incorporated by reference herein in its entirety.

TECHNICAL FIELD

The present invention relates to an anodic oxide coating, a treatment method therefor, and a piston for an internal combustion engine, and particularly relates to an anodic oxide coating for aluminum and aluminum alloys, a treatment method for an anodic oxide coating, and a piston for an internal combustion engine, the piston comprising an anodic oxide coating. This application claims priority from Japanese Patent Application No. 2014-065955 filed on Mar. 27, 2014, and Japanese Patent Application No. 2014-253062 filed on Dec. 15, 2014, which are incorporated herein by reference in their entirety.

BACKGROUND ART

Conventionally, as a method for improving the corrosion resistance of aluminum and aluminum alloys (hereinafter also referred to as aluminum-based materials), an anodizing treatment has been employed by which a porous anodic oxide coating is formed on a surface of an aluminum-based material. In the porous layer of the anodic oxide coating, which is formed mainly by direct-current electrolysis, pores are regularly arranged in general, although this greatly depends on the electrolysis conditions. Hence, its porosity is one of the causes of degradation of the corrosion resistance. To improve the corrosion resistance of an anodic oxide coating, a sealing treatment for filling the pores or the like is conducted after the anodic oxide coating treatment.

As such an anodizing treatment, it is known that the film formation speed of an anodic oxide coating is improved by a method for an anodizing treatment on an aluminum-based material in which an aluminum-based material serving as a workpiece is immersed in a treatment bath, a direct current is applied thereto, and then an AC-DC superimposition current is applied in which a high-frequency current is superimposed on the direct current, and it is also known that this method may be applied to a piston head (PTL 1). In addition, a technology for improving the corrosion resistance is known which is not based on a sealing treatment but which is based on a dense anodic oxide coating in the vicinity of an aluminum-based material obtained by adjusting the electrolysis conditions in an anodizing treatment (PTL 2).

CITATION LIST

Patent Literature

[PTL 1] Japanese Patent Application Publication No. 2009-235539

[PTL 2] Japanese Patent Application Publication No. 2006-83467

SUMMARY OF INVENTION

Technical Problems

In such an anodizing treatment, pores are formed regularly in a growth process of the anodic oxide coating. In particular, in an aluminum-based material containing impurity elements, such as an aluminum alloy, it is difficult for the anodic oxide coating to grow around the impurity elements, and pores tend to form there. When an anodic oxide coating in the vicinity of an aluminum-based material is dense, the heat insulation properties are low, because the pores are relatively scarce. In addition, when multiple cylindrical pores are present in a surface of an anodic oxide coating, it is not possible to achieve both high heat insulation properties and high corrosion resistance.

When such an anodic oxide coating is used for a piston for an internal combustion engine or the like, the anodic oxide coating is required to have extremely high durability and impact resistance sufficient to withstand impact of combustion, and to have a water-repellent function and an oil-repellent function for preventing adhering of fuel to a head surface of a piston for an internal combustion engine and for preventing adhering of unburned materials.

In view of the above-described problems, an object of the present invention is to provide an anodic oxide coating for an aluminum-based material, a treatment method therefor, and a piston for an internal combustion engine, the anodic oxide coating having both high heat insulation properties and high corrosion resistance, high durability and high impact resistance, and high water-repellent and oil-repellent functions.

In an aspect, a treatment method for an anodic oxide coating according to the present invention comprises the steps of: forming a second anodic oxide coating by application of AC-DC superimposition electrolysis to an aluminum-based material; and after the step, forming a first anodic oxide coating by application of direct-current electrolysis to the aluminum-based material, wherein the second anodic oxide coating is formed on the first anodic oxide coating.

In addition, in an aspect, an anodic oxide coating according to the present invention is an anodic oxide coating comprising at least: a first anodic oxide coating on a surface of an aluminum-based material; and a second anodic oxide coating on a surface of the first anodic oxide coating, wherein the first anodic oxide coating has more pores therein than the second anodic oxide coating.

The present invention makes it possible to obtain an anodic oxide coating for an aluminum-based material, a treatment method therefor, and a piston for an internal combustion engine, the anodic oxide coating having both high heat insulation properties and high corrosion resistance, high durability and high impact resistance, and high water-repellent and oil-repellent functions.

DESCRIPTION OF EMBODIMENTS

Anodic Oxide Coating (First Embodiment)

Figure 1:
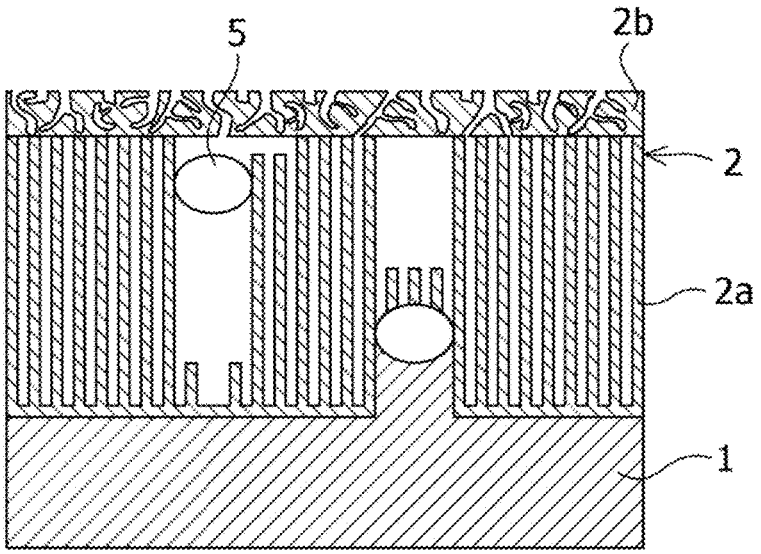
FIG. 1 is a cross-sectional view schematically showing an anodic oxide coating of a first embodiment of an anodic oxide coating, a treatment method therefor, and a piston for an internal combustion engine according to the present invention.

An embodiment of an anodic oxide coating according to the present invention is described in further detail with reference to the attached drawings. FIG. 1 is a schematic cross-sectional view showing an anodic oxide coating 2 of this embodiment. As shown in FIG. 1, the anodic oxide coating 2 is provided on a surface of an aluminum-based material 1. Note that when the aluminum-based material 1 is an aluminum alloy containing silicon as an impurity and/or additive, silicon 5 is included inside the surface of the anodic oxide coating.

The aluminum-based material 1 is a workpiece to be coated with the anodic oxide coating 2. The meaning of "aluminum-based material" in this embodiment includes not only aluminum, but also aluminum alloys containing alloy components such as silicon and copper and aluminum alloys such as wrought aluminum materials, cast aluminum materials, and die-cast aluminum materials (ADC) containing such alloy components. More specifically, the aluminum alloys include AC materials such as AC4, AC8, AC8A, and AC9, ADC materials such as ADC10 to ADC14, A1000 to A7000, and the like. The aluminum-based material 1 can be an aluminum-based member processed into a component or the like. The aluminum-based material 1 and/or the aluminum-based member are preferably used for a piston for an internal combustion engine in which the anodic oxide coating 2 is required to have high impact resistance, durability, heat insulation properties, water repellency, oil repellency, and the like. The anodic oxide coating 2 of this embodiment can satisfy the requirements for the above-described performances. Note that, in this embodiment, the "heat insulation properties" required for an internal combustion engine mean performances and/or functions of thermally insulating heat from a combustion portion of an internal combustion engine to the outside and/or heat from the outside to the combustion portion.

The aluminum-based material 1 may contain impurities and/or additives. The impurities and/or additives include silicon (Si), copper (Cu), magnesium (Mg), zinc (Zn), iron (Fe), tin (Sn), manganese (Mn), nickel (Ni), titanium (Ti), and the like. These impurities and/or additives are preferably 8% by mass or more and 30% by mass or less relative to the aluminum-based material. Since the impurities and/or additives also lead to the formation of pores in the anodic oxide coating 2, the impurities and/or additives can contribute to the heat insulation properties of the anodic oxide coating 2. Note that, in this embodiment, the silicon 5 is shown as an example of the impurities. The silicon 5 is added to enhance the castability, the wear resistance, and the like of the aluminum-based material 1.

The anodic oxide coating 2 includes a first anodic oxide coating 2*a* and a second anodic oxide coating 2*b*. The two-layer structure of the anodic oxide coating 2 including the first anodic oxide coating 2*a* and the second anodic oxide coating 2*b* imparts multiple functions such as heat insulation properties, corrosion resistance, durability, impact resistance, water repellency, and oil repellency to the aluminum-based material 1.

The first anodic oxide coating 2*a* is a porous coating provided on the surface of the aluminum-based material 1 by application of direct-current electrolysis. The first anodic oxide coating 2*a* has a regular orientation. For this reason, the first anodic oxide coating 2*a* has more pores (first pores) than the second anodic oxide coating 2*b*. In other words, the first anodic oxide coating 2*a* is sparse and the second anodic oxide coating 2*b* is dense in terms of the size, number, and/or distribution of the pores. In addition, the first pores are formed also because of the presence of the silicon 5 and the like.

The air in the many first pores present on the surface of and inside the first anodic oxide coating 2*a* has a low thermal conductivity. Hence, the first anodic oxide coating 2*a* has higher heat insulation properties than the second anodic oxide coating 2*b*. In addition, the first anodic oxide coating 2*a* has corrosion resistance, and can prevent a substance which may cause corrosion from reaching the aluminum-based material 1. Accordingly, the first anodic oxide coating 2*a* imparts high heat insulation properties and a high corrosion resistance to the aluminum-based material 1, and, in cooperation with the second anodic oxide coating 2*b*, imparts a highly reliable heat insulation performance to the aluminum-based material 1.

The second anodic oxide coating 2*b* is a porous coating provided on the surface of the aluminum-based material 1 by application of AC-DC superimposition electrolysis, and has multiple pores (second pores). In addition, the second pores are formed also because of the presence of the silicon 5 and the like. The second anodic oxide coating 2*b* has a denseness attributable to the random orientation. Specifically, the second anodic oxide coating 2*b* is an anodic oxide coating which has grown in random directions with respect to the surface of the aluminum-based material 1, and which does not have orientation. For this reason, the second anodic oxide coating 2*b* can prevent a substance which may cause corrosion, for example, water, from reaching the aluminum-based material to a greater degree, and provides a higher corrosion resistance than the first anodic oxide coating 2*a*. More specifically, since the second pores are oriented in random directions, it is also possible to prevent substance water which causes corrosion, such as water, from entering many pores at once under a pressure in a direction. Note that the "denseness" means that the size and the number (distribution) of pores are smaller than those of other anodic oxide coatings.

The second anodic oxide coating 2*b* can improve the heat insulation properties of the first anodic oxide coating 2*a* by covering the pores of the first anodic oxide film 2*a* as a lid for the first anodic oxide coating 2*a*, without filling the pores. In addition, the second anodic oxide coating 2*b* can prevent a substance which may cause corrosion from reaching the aluminum-based material 1. That is, the second anodic oxide coating 2*b* imparts a high corrosion resistance to the aluminum-based material 1, and improves the heat insulation properties of the first anodic oxide film 2*a*. The second anodic oxide coating 2*b* has not only high corrosion resistance, but also high density, high hardness, and low surface roughness. A low surface roughness means that the surface of the second anodic oxide coating 2*b* is flat and smooth. For this reason, when the anodic oxide coating 2 is used for a piston for an internal combustion engine, the second anodic oxide coating 2*b* can impart durability and impact resistance sufficient to withstand impact of combustion to the anodic oxide coating 2, and prevent adhering of fuel and adhering of unburned materials.

The first anodic oxide coating 2*a* and the second anodic oxide coating 2*b* are preferably formed in a single anodizing treatment bath, and are more preferably formed under substantially the same temperature conditions. In this case, the components of the first anodic oxide coating 2*a* and the components of the second anodic oxide coating 2*b* are substantially the same. Hence, a connecting portion (boundary portion) between the first anodic oxide coating 2*a* and the second anodic oxide coating 2*b* can be formed continuously. This makes it possible to obtain an integrated and firm connecting portion between the first anodic oxide coating 2*a* and the second anodic oxide coating 2*b*. Consequently, the first pores of the first anodic oxide coating 2*a* are prevented from being filled by a sealing treatment, described later, so that degradation of heat insulation properties can be prevented. In addition, it is possible to prevent occurrence of adhesion failure, peeling, or the like between the anodic oxide coatings. Furthermore, the first anodic oxide coating 2*a* and the second anodic oxide coating 2*b* impart a highly reliable durability performance and a highly reliable impact resistance performance to the aluminum-based material 1.

As an anodizing treatment liquid for forming the first anodic oxide coating 2*a* and the second anodic oxide coating 2*b*, any one of acidic baths of sulfuric acid ($H_2SO_4$), oxalic acid ($H_2C_2O_4$), phosphoric acid ($H_3PO_4$), chromic acid ($H_2CrO_4$), and the like, or basic baths of sodium hydroxide (NaOH), sodium phosphate ($Na_3PO_4$), sodium fluoride (NaF), and the like may be used. The aluminum-based material 1 on the surface of which the anodic oxide coating 2 is formed is not limited to a case in which a specific anodizing bath is used, but sulfuric acid is preferable from a practical point of view. When a phosphoric acid bath is used, the size and the number (distribution) of the pores of the first anodic oxide coating 2*a* can be increased depending on the electrolysis conditions.

The film thickness of the anodic oxide coating 2 is not particularly limited. More specifically, the film thickness of the anodic oxide coating 2 is preferably 3 μm to 300 μm from the viewpoint of practicability. The film thickness can be set to a film thickness necessarily for the application.

In addition, when the anodic oxide coating 2 is used for a piston for an internal combustion engine, the second anodic oxide coating 2*b* is provided on a head surface. Hence, it is possible to prevent adhering of fuel and adhering of unburned material to the head surface. Consequently, it is possible to prevent engine trouble due to adhering of deposits. Moreover, since the first anodic oxide coating 2*a* has a higher porosity (lower density) than the second anodic oxide coating 2*b*, the first anodic oxide coating 2*a* is a coating with a low hardness. On the other hand, the second anodic oxide coating 2*b* has a lower porosity (higher density), and hence has a higher hardness than the first anodic oxide coating 2*a*. The surface roughness is lower in a case in which the second anodic oxide coating 2*b* is present on the topmost surface than in a case in which the first anodic oxide coating 2*a* is present on the topmost surface. In other words, a coating with a smaller heat-receiving area is obtained in the case in which the second anodic oxide coating 2*b* is present on the topmost surface, and the coating with a smaller heat-receiving area is advantageous to the heat insulation properties. In this manner, a synergistic effect of the first anodic oxide coating 2*a* and the second anodic oxide coating 2*b* makes it possible to obtain an anodic oxide coating 2 having a high strength and highly reliable heat insulation properties.

If necessary, the anodic oxide coating 2 (the first anodic oxide coating 2*a* and the second anodic oxide coating 2*b*) can be subjected to a sealing treatment. When a sealing treatment is conducted on the first anodic oxide coating 2*a*, the second anodic oxide coating 2*b* and/or the aluminum-based material 1 including the first anodic oxide coating 2*a* and the second anodic oxide coating 2*b*, it is possible to obtain a first anodic oxide coating and a second anodic oxide coating in which the first pores and the second pores are sealed with a product (not shown) originating from a strong-base treatment liquid. This makes it possible to further improve the corrosion resistance of the first anodic oxide coating, the second anodic oxide coating, and the aluminum-based material. The sealing treatment is described later.

Note that the anodic oxide coating 2 after an anodic oxide coating formation step has a sufficiently high heat resistance and a sufficiently high corrosion resistance, even without performing a corrosion inhibition treatment such as the sealing treatment. For this reason, although treatments such as the above-described sealing treatment, a washing treatment, a repairing treatment, and a coating treatment can be conducted, the sealing treatment can be omitted. Whether or not it is necessary to carry out the sealing treatment by conducting a sealing treatment on the anodic oxide coating 2 can be determined, as appropriate, depending on a required function. In this case, the labor can be reduced, and the production costs can be reduced.

[Treatment Method for Anodic Oxide Coating]

By describing a mode of operation of the anodic oxide coating having the above-described configuration, one embodiment of a treatment method for an anodic oxide coating will be described in further detail with reference to the attached drawings.

Figure 2:
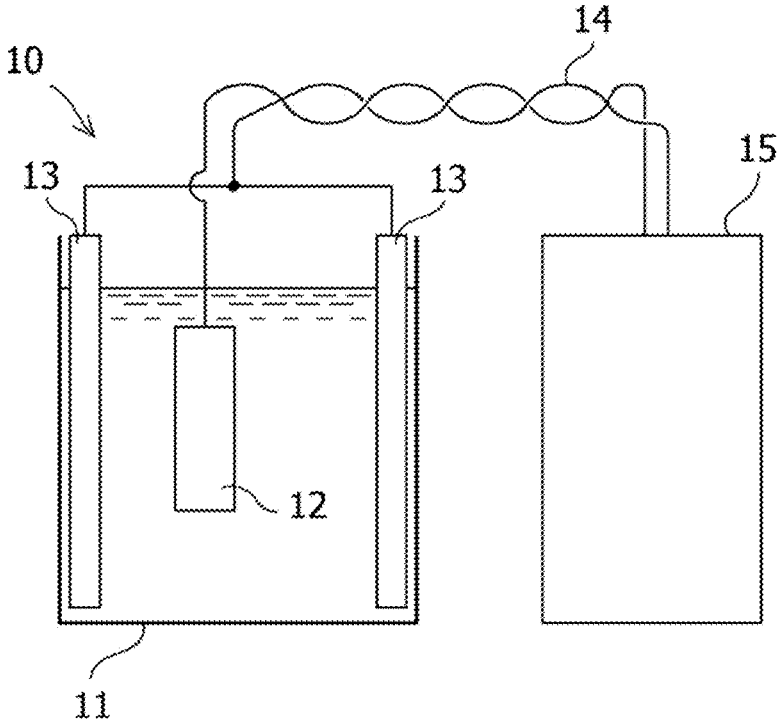
FIG. 2 is a structural view which relates to the anodic oxide coating, the treatment method therefor, and the piston for an internal combustion engine according to the present invention, and which schematically shows an anodizing treatment apparatus used in the treatment method for an anodic oxide coating.

FIG. 2 is a structural view showing an outline of an anodizing treatment apparatus 10 used in a treatment method for an anodic oxide coating 2. The anodizing treatment apparatus 10 includes an electrolytic tank 11 which houses an anodizing treatment liquid, an anode 12 and a pair of cathodes 13 immersed in the anodizing treatment liquid, a lead wire 14, and a power source 15. The pair of cathodes 13 are arranged to face each other in the electrolytic tank 11, with the anode 12 placed at the center between the cathodes 13. The anode 12 and the pair of cathodes 13 are connected to the power source 15 through the lead wire 14. In addition, the anodizing treatment apparatus 10 is configured to apply direct-current electrolysis and AC-DC superimposition electrolysis by the power source 15 through the anode 12, the pair of cathodes 13, and the lead wire 14.

The anodizing treatment apparatus 10 preferably includes a stirring apparatus (not shown) capable of stirring the anodizing treatment liquid. This makes it possible to prevent local burning due to generated bubbles and the like, and assist the anodic oxide coating 2 to grow uniformly. In addition, each of the pair of cathodes 13 is preferably configured such that the surface area of the cathode 13 immersed in the anodizing treatment liquid can be 20 times or more greater than the surface area of the aluminum-based material 1 serving as the anode 12. This makes it possible to obtain a uniform anodic oxide coating 2.

In an anodic oxide coating formation step, the aluminum-based material 1 and titanium (Ti) are respectively placed as the anode 12 and as the cathodes 13 in the anodizing treatment liquid. By electrolyzing the anodizing treatment liquid, the anodic oxide coating 2 containing aluminum oxide as a main component is formed in the vicinity of the surface of the aluminum-based material 1. The anodic oxide coating 2 imparts functions such as corrosion resistance and wear resistance to the aluminum-based material 1. Note that the material of the cathodes 13 may be of any type, as long as the material can function as the cathodes 13, and besides titanium, a carbon plate, an aluminum plate, a stainless steel plate, and the like can be used.

In a first anodic oxide coating formation step, the second anodic oxide coating 2*b* is formed by application of AC-DC superimposition electrolysis to the aluminum-based material 1. In other words, the first anodic oxide coating formation step is carried out by an AC-DC superimposition method in which an alternating current is superimposed on a direct current (hereinafter, this method is also referred to as an AC-DC superimposition electrolysis method). In this step, the second anodic oxide coating 2*b* is formed in the vicinity of the surface mainly including an upper portion of the surface of the aluminum-based material 1. The second anodic oxide coating 2*b* is a porous coating which is provided in the vicinity of the surface of the aluminum-based material by application of AC-DC superimposition electrolysis, and has multiple pores (second pores). The second anodic oxide coating 2*b* is dense because of random orientation. Hence, the corrosion resistance is high because it is possible to make a substance that may cause corrosion less likely to penetrate to the aluminum-based material. In addition, the hardness is high, and the surface roughness is low (the surface is flat and smooth).

The second anodic oxide coating 2*b* formed in the first anodic oxide coating formation step covers the pores of the first anodic oxide coating 2*a* as a lid for the first anodic oxide coating 2*a*, without filling the pores. This makes it possible to maintain or improve the heat insulation properties of the first anodic oxide coating 2*a*. In addition, the second anodic oxide coating 2*b* can prevent a substance which may cause corrosion from reaching the aluminum-based material 1. That is, the second anodic oxide coating 2*b* imparts a high corrosion resistance to the aluminum-based material 1, and improves the heat insulation properties of the anodic oxide coating 2.

In a second anodic oxide coating formation step after the first anodic oxide coating formation step, the first anodic oxide coating 2*a* is formed by application of direct-current electrolysis to the aluminum-based material 1 having the second anodic oxide coating 2*b* (hereinafter, this method is also referred to as a direct-current electrolysis method). In this step, the second anodic oxide coating 2*b* is formed in the vicinity of the surface of the aluminum-based material 1. In other words, the first anodic oxide coating 2*a* is formed between the second anodic oxide coating 2*b* and the aluminum-based material 1. Because of its orientation, the first anodic oxide coating 2*a* has more pores (first pores) than the second anodic oxide coating 2*b*. In other words, the first anodic oxide coating 2*a* is sparse, and the second anodic oxide coating 2*b* is dense in terms of the size, number, and/or distribution of the pores. In addition, the first pores are formed also because of the presence of the silicon 5 and the like.

Many first pores are present on the surface of and inside the first anodic oxide coating 2*a* formed in the second anodic oxide coating formation step. Since the air in the first pores has low thermal conductivity, the first anodic oxide coating 2*a* has higher heat insulation properties than the second anodic oxide coating 2*b*. In addition, the first anodic oxide coating 2*a* also has corrosion resistance attributable to aluminum oxide, and can prevent a substance which may cause corrosion from reaching the aluminum-based material 1. The first anodic oxide coating 2*a* can impart corrosion resistance to the aluminum-based material 1, and can impart highly reliably heat insulation properties to the aluminum-based material 1 by a synergistic effect with the second anodic oxide coating 2*b*.

The first anodic oxide coating formation step and the second anodic oxide coating formation step can be carried out in different anodizing treatment liquids or at different temperatures depending on the purpose, but are preferably carried out in a single anodizing treatment liquid, and more preferably carried out further at the same temperature. In this case, the components of the first anodic oxide coating 2*a* and the components of the second anodic oxide coating 2*b* are substantially the same. Hence, the first anodic oxide coating 2*a* and the second anodic oxide coating 2*b* can be formed continuously. This makes it possible to obtain an integrated and firm connecting portion between the anodic oxide coating 2*a* formed by the direct-current electrolysis and the anodic oxide coating 2*b* formed by the AC-DC superimposition electrolysis. Consequently, this eliminates the possibility that the pores of the anodic oxide coating formed by the direct-current electrolysis may be filled in a sealing treatment, described later, and makes it possible to prevent degradation of heat insulation properties. In addition, it is possible to prevent occurrence of adhesion failure, peeling, or the like between the anodic oxide coatings. This makes it possible to obtain high durability.

As the anodizing treatment liquid, any one of acidic baths of sulfuric acid ($H_2SO_4$), oxalic acid ($H_2C_2O_4$), phosphoric acid ($H_3PO_4$), chromic acid ($H_2CrO_4$), and the like, or basic baths of sodium hydroxide (NaOH), sodium phosphate ($Na_3PO_4$), sodium fluoride (NaF), and the like may be used. The aluminum-based material 1 on the surface of which the anodic oxide coating 2 to be subjected to a sealing treatment, described later, is formed not limited to a case in which a specific anodizing bath is used, but sulfuric acid is preferable from the practical viewpoint.

The temperature of the anodizing treatment liquid may be any temperature, as long as the first anodic oxide coating 2*a* and the second anodic oxide coating 2*b* can be formed at the temperature. More specifically, the temperature of the anodizing treatment liquid is preferably 5.0° C. to 30° C., and more preferably 10° C. to 20° C. If the temperature is within the above-described range, for example, both the first anodic oxide coating 2*a* and the second anodic oxide coating 2*b* having predetermined hardness are capable of being formed by an anodizing treatment, while eliminating the need for film formation involving cooling to about 0° C., such as the hard coating method. In addition, the continuity of the connecting portion between the first anodic oxide coating 2*a* and the second anodic oxide coating 2*b* is improved, so that an integrated and firm anodic oxide coating 2 can be obtained.

The frequency of a high-frequency current in the first anodic oxide coating formation step is preferably 5 kHz to 20 kHz, and more preferably 10 kHz to 20 kHz. In addition, the voltage of the positive electrode is preferably 12 V to 70 V, and the voltage of the negative electrode is preferably −10

V to 0 V. Within the above-described ranges, it is possible to improve the uniformity of the thickness of the coating and obtain the second anodic oxide coating 2*b* which has corrosion resistance, water repellency, and oil repellency with low variations among portions. Note that, the current application time is not particularly limited, and the application can be carried out in a practical time.

In a sealing treatment step, an ordinary sealing treatment can be applied. The sealing treatment may be a strongly basic sealing bath, boiling water sealing, nickel salt sealing, or the like. In the sealing treatment step in this embodiment, a sealing liquid is attached to the surface of the anodic oxide coating 2 to cause the pores of the anodic oxide coating 2 to penetrate into the sealing liquid. The sealing liquid enters the pores of the anodic oxide coating 2, and forms a compound in the pores. In particular, the sealing liquid enters mainly the second pores of the second anodic oxide coating 2*b*, and forms the compound therein. This makes it possible to improve the heat insulation properties of the anodic oxide coating 2. The sealing treatment step is preferably conducted as follows. Specifically, a treatment liquid is applied or sprayed onto the workpiece having the anodic oxide coating 2, or the workpiece is immersed in the treatment liquid. Then, the workpiece is held in the air, then washed with water, and dried. In addition, it is preferable that the workpiece having the anodic oxide coating 2 be immersed in the treatment liquid, taken out of the treatment liquid after 0.5 minutes or more, and washed with water and dried. The sealing treatment method based on the application or spray enables a partial sealing treatment. For this reason, in a treatment on a large component, it is possible to eliminate the need for a large tank for immersing the large component in the treatment.

In the sealing treatment step, the second anodic oxide coating 2*b* serves as a lid of the first anodic oxide coating 2*a*, and covers the first pores, without filling the pores. Accordingly, the degradation of the heat insulation properties of the first anodic oxide coating 2*a* can be prevented, without sealing the many first pores in the sealing treatment. In addition, the connecting portion between the first anodic oxide coating 2*a* and the second anodic oxide coating 2*b* is formed to be integrated and firm. Hence, the sealing treatment makes it possible to improve the corrosion resistance, while preventing degradation of the heat insulation properties and decrease in the reliability of the heat insulation properties.

Note that the anodic oxide coating 2 after the anodizing treatment step has a sufficiently high heat resistance and a sufficiently high corrosion resistance, even without performing a corrosion inhibition treatment such as the sealing treatment. For this reason, the sealing treatment can be omitted, among post treatments including the sealing treatment, the washing treatment, the repairing treatment, the coating treatment, and the like. Whether or not it is necessary to carry out the sealing treatment by conducting a sealing treatment on the anodic oxide coating 2 can be determined, as appropriate, depending on a required function. When the sealing treatment is carried out, the corrosion resistance of the anodic oxide coating 2 can be improved. If no sealing treatment is carried out, the labor can be reduced, and the production costs can be reduced.

Problems Solved by this Embodiment and Operations and Effects

For example, in the anodic oxide coating formed by direct-current electrolysis of Japanese Patent Application Publication No. 2009-235539 (Patent Document 1), pores penetrating the anodic oxide coating from the surface of the anodic oxide coating to the vicinity of an aluminum-based material are present, and hence heat enters the anodic oxide coating through the pores to the vicinity of the aluminum-based material. Accordingly, heat conduction to the aluminum-based material occurs. Consequently, there arises a problem of low heat insulation properties. In addition, in a case in which fuel containing water, a corrosive substance, or the like is present, the anodic oxide coating cannot absorb the fuel or the substance. For this reason, the fuel or the substance passes through the pores penetrating the anodic oxide coating to the vicinity of the aluminum-based material and reaches the aluminum-based material. Consequently, there arises a problem of degradation of corrosion resistance. In addition, when a dense anodic oxide coating is present in the vicinity of an aluminum-based material as is exemplified in Japanese Patent Application Publication No. 2006-83467 (Patent Document 2), the pores are fewer in this dense anodic oxide coating than in an anodic oxide coating formed by direct-current electrolysis. Consequently, there arises a problem of lower heat insulation properties than those of an anodic oxide coating formed with a direct current.

Especially when an anodic oxide coating is used for a piston for an internal combustion engine (especially a head surface) or the like, the anodic oxide coating is required to have extremely high durability and impact resistance sufficient to withstand the repeated stress due to the explosion pressure, the injection pressure, the thermal expansion, and the thermal contraction during the combustion. However, an anodic oxide coating formed with a direct current has a low density, and hence has a low hardness. Therefore, there is a possibility that the anodic oxide coating cannot withstand use for a piston for an internal combustion engine, and may be broken. Moreover, an anodic oxide coating formed with a direct current has a high surface roughness, and hence has low water-repellent and oil-repellent functions. For this reason, adhering of fuel and adhering of unburned materials to a head surface of a piston for an internal combustion engine occur. Consequently, there arises a problem of engine trouble due to the adhering of deposit. For example, in the anodic oxide coating of Patent Document 1, multiple cylindrical pores are present in the surface of the anodic oxide coating, and hence improvement in heat insulation properties and corrosion resistance cannot be expected.

In addition, when the pores of an anodic oxide coating are sealed by a sealing treatment, the pores may be filled to a great extent, and hence there arises a problem of degradation of the heat insulation properties of the anodic oxide coating. Furthermore, the sealing treatment is conducted by using a treatment liquid which has different components from the components of that used in the anodizing treatment. For this reason, adhesion failure, peeling, or the like may occur between a portion subjected to the sealing treatment and the anodic oxide coating. In other words, there arises a problem of possible degradation of the durability of the anodic oxide coating. Furthermore, the sealing treatment step is conducted as a separate step after the anodizing treatment step. Accordingly, the formed inner pores may be blocked during transfer between the steps. This causes a problem of degradation of heat resistance. Moreover, this increases the number of steps and control items, causing a problem of increased production costs.

In contrast, in the configuration according to this embodiment, the first anodic oxide coating 2*a* formed by direct-current electrolysis and having high heat insulation properties is provided on the aluminum-based material 1 side, and the second anodic oxide coating 2b formed by AC-DC superimposition electrolysis and having a high corrosion resistance is provided on the outer peripheral side of the first anodic oxide coating 2a. For this reason, the second anodic oxide coating 2b formed by AC-DC superimposition electrolysis functions as a lid covering the outer periphery of the first anodic oxide coating 2a formed by direct-current electrolysis, and covers the nano-level and micro-level first pores of the first anodic oxide coating 2a, without filling the pores. The makes it possible to obtain the anodic oxide coating 2 having both high heat insulation properties and a high corrosion resistance.

In addition, in the configuration according to this embodiment, the second anodic oxide coating 2b formed by AC-DC superimposition electrolysis and having a high density and a high hardness is positioned as the upper layer in the anodic oxide coating 2. For this reason, especially when the anodic oxide coating 2 is used for a piston for an internal combustion engine, it is possible to obtain an anodic oxide coating 2 having high durability and impact resistance sufficient to withstand the repeated stress due to the explosion pressure, the injection pressure, the thermal expansion, and the thermal contraction during the combustion. In addition, the second anodic oxide coating 2b can be configured to be provided on a head surface. Consequently, it is possible to obtain an anodic oxide coating 2 sufficient to withstand in the use for a piston for an internal combustion engine.

Moreover, according to this embodiment, the second anodic oxide coating 2b formed by AC-DC superimposition electrolysis has a low surface roughness. In other words, the smoothness of the surface of the second anodic oxide coating 2b is high. For this reason, the second anodic oxide coating 2b and the anodic oxide coating 2 having the second anodic oxide coating 2b as the upper layer have high water repellency and high oil repellency. In addition, the second anodic oxide coating 2b and the anodic oxide coating 2 have small surface areas, and hence receive less heat. Accordingly, when the anodic oxide coating 2 is used for a piston for an internal combustion engine, it is possible to prevent adhering of fuel and adhering of unburned materials to the head surface, because the second anodic oxide coating 2b is provided on a head surface. Accordingly, engine trouble due to attachment of deposit can be prevented from occurring.

Furthermore, according to this embodiment, the components of the first anodic oxide coating 2a and the components of the second anodic oxide coating 2b are substantially the same, and the first anodic oxide coating 2a and the second anodic oxide coating 2b are formed continuously. This makes it possible to obtain an integrated and firm connecting portion between the first anodic oxide coating 2a formed by direct-current electrolysis and the second anodic oxide coating 2b formed by AC-DC superimposition electrolysis. Consequently, many first pores of the first anodic oxide coating 2a are prevented from being filled, so that the degradation of the high heat insulation properties of the first anodic oxide coating 2a can be prevented. In addition, it is possible to prevent occurrence of adhesion failure, peeling, or the like between the anodic oxide coatings. This makes it possible to obtain highly reliable heat insulation properties and a highly reliable durability.

Anodic Oxide Coating (Second Embodiment)

Figure 3:
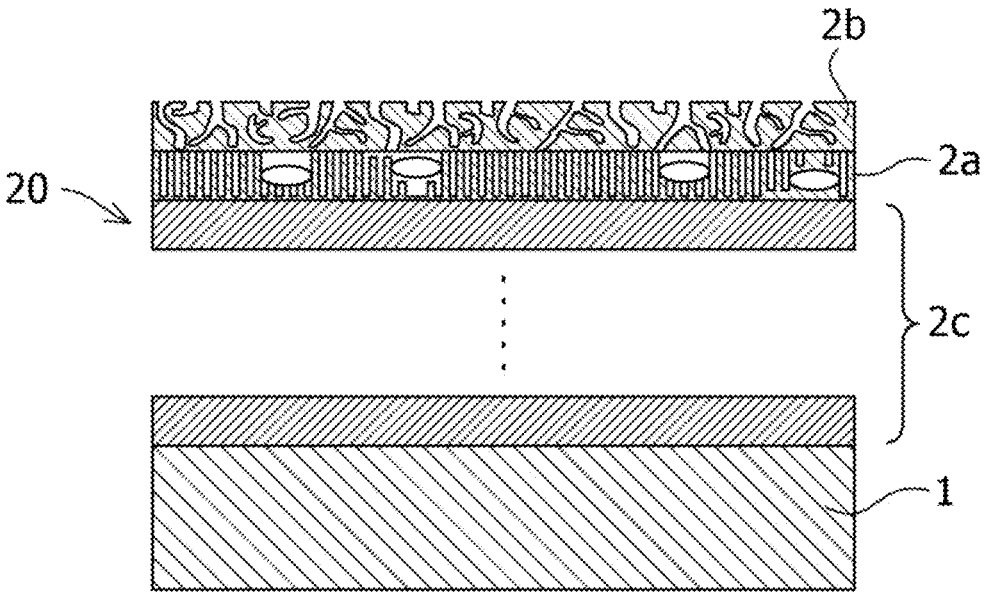
FIG. 3 is a cross-sectional view schematically showing an anodic oxide coating of a second embodiment of the anodic oxide coating, the treatment method therefor, and the piston for an internal combustion engine according to the present invention.

Subsequently, a second embodiment of the present invention is described by using FIG. 3. As shown in FIG. 3, an anodic oxide coating 20 of this embodiment is formed on a surface of the aluminum-based material 1, and includes at least the first anodic oxide coating 2a, the second anodic oxide coating 2b, and an additional layer 2c. Note that the same constituents as those in the above-described embodiments are denoted by the same reference numerals as those in FIGS. 1 and 2, and descriptions thereof are omitted.

The additional layer 2c includes at least one or more anodic oxide coatings and is formed between the aluminum-based material 1 and the first and the second anodic oxide coatings 2a and 2b. The additional layer 2c is formed by carrying out any known chemical treatment, in addition to the first or second anodic oxide coating formation step of the first embodiment. In this manner, the additional layer 2c provides a further supplemental or additional function to the anodic oxide coating 20. Moreover, the additional layer 2c provides a synergistic function to the anodic oxide coating 20 by combining a function of the additional layer 2c itself with a function of the first or second anodic oxide coating 2a or 2b.

Supplemental, additional, or synergistic functions provided by the additional layer 2c include characteristics necessary for the structure, i.e., strength, wear resistance, corrosion resistance, smoothness, heat-shielding properties, adhesiveness and durability associated with functional grading and thermal expansion, optical characteristics associated with reflection, absorption, and transmission, thermal conductivity associated with radiation, conduction, and convection, properties of allowing adhering of unburned fuel such as carbon, oil- and water-repellency, electric (electromagnetic) characteristics, design properties based on coloring or interference, and/or the like. The coating for providing a supplemental, additional, or synergistic function to the anodic oxide coating 20 may be at least one layer of multiple layers formed in the additional layer 2c. The position of the coating among the layers in additional layer 2c is determined according to the characteristics necessary for the structure.

For example, it is possible to impart further functions such as exhaust gas purification performance to the anodic oxide coating 20 by supporting a catalyst in the pores of the anodic oxide coating in the additional layer 2c formed by a direct-current electrolysis treatment. Moreover, for example, it is possible to impart functions such as design properties to the anodic oxide coating 20 by attaching a coloring dye to the pores of the anodic oxide coating in the additional layer 2c. In this manner, a supplemental or additional function is provided to the anodic oxide coating 20.

In addition, the additional layer 2c may include layers which are the same as the first anodic oxide coatings 2a and the second anodic oxide coatings 2b formed in an alternate manner. This makes it possible to obtain an anodic oxide coating 20 in which the first anodic oxide coatings 2a and the second anodic oxide coatings 2b are formed in an alternate manner. In this case, the second anodic oxide coating 2b and the first anodic oxide coating 2a are formed in an alternate manner on the aluminum-based material 1 by the above-described anodic oxide coating formation steps, and then the additional layer 2c is formed by further conducting the first anodic oxide coating formation step and the second anodic oxide coating in an alternate manner. After that, if necessary, a corrosion inhibition treatment such as a sealing treatment is carried out. Consequently, it is possible to obtain an anodic oxide coating 20 having a higher impact resistance, a higher wear resistance, and a higher corrosion resistance than a coating having the two-layer structure.

The number N of layers in the additional layer 2c (N is a natural number of one or greater) is not particularly limited, as long as the number N is one or greater. For example, the number of layers in the additional layer 2c can be four. In other words, the number N+2 of layers in the anodic oxide coating 20 is not particularly limited, as long as the number N+2 is three or greater. For example, the number of layers in the anodic oxide coating 20 may be six. In this case, the fine structure of the anodic oxide coating 20 is made more complicated, so that the corrosion resistance and the oil resistance of the anodic oxide coating 20 can be improved. In addition, a force applied from the outside to the surface of the anodic oxide coating 20 can be relaxed, before reaching the aluminum-based member 1. Hence, the impact resistance of the anodic oxide coating 20 can be improved.

According to this embodiment, a function combining a function of the additional layer 2*c* with a function of the first and/or second anodic oxide coatings 2*a* and/or 2*b* can be imparted to the anodic oxide coating 20 in a mixed manner, so that a synergistic function necessary for the anodic oxide coating 20 can be provided. In addition, a further supplemental or additional function can be provided to the anodic oxide coating 20 by conducting any known chemical treatment in addition to the anodic oxide coating formation steps of the first embodiment. Moreover, by employing the first anodic oxide coatings 2*a* and the second anodic oxide coatings 2*b* formed in an alternate manner as the additional layer 2*c* having N layers, the anodic oxide coating 20 having N+2 layers can be prepared in the forms of layers in which the first anodic oxide coatings 2*a* and the second anodic oxide coatings 2*b* are formed in an alternate manner. Consequently, the impact resistance, the wear resistance, and the corrosion resistance of the anodic oxide coating and the piston for an internal combustion engine using the anodic oxide coating can be improved more in this embodiment than in the first embodiment.

Note that it is also possible to provide a supplemental or additional function to the anodic oxide coating 20 by coatings formed by the first and second anodic oxide coating formation steps alone. Major differences in the structure between a coating formed by a direct-current electrolysis treatment and a coating formed by an AC-DC superimposition electrolysis treatment are the orientation of the growing structure and the density. Hence, it is possible to impart further functions such as mechanical, thermal, electric (electromagnetic), and optical characteristics to the anodic oxide coating 20 by forming these coatings in a combined manner. Note that, in performing the combined treatments, the direct-current electrolysis treatment is regarded as an electrolysis treatment with orientation, and the AC-DC superimposition electrolysis treatment is regarded as an electrolysis treatment without orientation. An electrolysis treatment without orientation means that a negative voltage is applied in a specific period to change the growth direction (orientation) of the coating, and the waveform (sine wave, rectangular wave, triangle wave, or the like) is not limited. An object of this embodiment is not simply to improve a function of the anodic oxide coating 20, but an important object of the embodiment is to provide a synergistic, supplemental, or additional function to the anodic oxide coating 20.

For example, in the formation of the anodic oxide coating 20 of this embodiment, the layer on the surface side of the anodic oxide coating 20 and the layer on the surface side of the aluminum-based member 1 are preferably formed by the electrolysis treatments in a single electrolytic tank filled with a single anodizing treatment liquid, as described in the first embodiment above. However, this embodiment is not limited thereto, in order to achieve the above-described object with clearly different coating properties. It is possible to form a first layer by an electrolysis treatment, then transfer the aluminum-based member 1 to another electrolytic tank filled with another anodizing treatment liquid, and form a second layer by conducting an electrolysis treatment in the electrolytic tank at a different temperature. However, another coating fabricated by changing the applied voltage or the current density does not increase the number of the layers. This is because, in forming an anodic oxide coating, one of the applied voltage or the current density inevitably varies, and the variation in the applied voltage or the current density does not cause any great change in the coating structure such as the denseness of the coating, and hence it cannot be said that such a coating have different properties.

In addition, in each of the first and second embodiments, the use of the aluminum-based member for a piston for an internal combustion engine is shown as an example; however, the present invention is not limited thereto. The aluminum-based member may be a component for an outboard engine, such as an oil pan, a gear case, or a propeller for an outboard engine. An outboard engine is a propulsion system attached to a marine vessel, and comes into contact with seawater and salt air. Hence, components constituting an outboard engine are required to have high corrosion resistance. For example, an oil pan, which stores an engine oil and also has a function to cool the engine oil with a stream of air during a cruise, has to come into direct contact with seawater and salt air. For this reason, a high corrosion resistance is required. Since the anodic oxide coating formed on the aluminum-based member of the present invention has a sufficient corrosion resistance, the aluminum-based member can also be used as a component for an outboard engine.

EXAMPLES

Hereinafter, the present invention will be described specifically based on Examples to clarify effects of the present invention. Neither the anodic oxide coating nor the treatment method for an anodic oxide coating according to the present invention is limited to the Examples below.

Test Example 1

A test piece prepared from an aluminum alloy (AC8A) was used as an aluminum-based material. This test piece was subjected to an anodizing treatment by using a direct-current electrolysis method to form an anodic oxide coating of 11 to 21 μm. The anodizing treatment was conducted at 1.5 A/dm$^2$ for 20 minutes in a sulfuric acid bath having a concentration of 200 g/L at 20° C. The fabricated test piece having a single-layer anodic oxide coating constituted of the anodic oxide layer formed by the direct-current electrolysis was employed as a test piece of Test Example 1.

Test Example 2

A test piece prepared from an aluminum alloy (AC8A) was used as an aluminum-based material. This test piece was subjected to an anodizing treatment by an AC-DC superimposition electrolysis method to form a coating of 16 to 18 μm. The anodizing treatment was conducted at 20° C. for 10 minutes in a sulfuric acid bath having a concentration of 200 g/L with 10 kHz and with a positive electrode at 25 V and a negative electrode at −2 V. The fabricated test piece having a single-layer anodic oxide coating constituted of the anodic oxide layer formed by the AC-DC superimposition electrolysis was employed as a test piece of Test Example 2.

Test Example 3

A test piece prepared from an aluminum alloy (AC8A) was used as an aluminum-based material. This test piece was subjected to an anodizing treatment by an AC-DC superimposition electrolysis method to form a coating. The anodizing treatment was conducted at 20° C. for 7 minutes in a sulfuric acid bath having a concentration of 200 g/L with 10 kHz and with a positive electrode at 25 V and a negative electrode at −2 V. After that, a coating was formed by an anodizing treatment using a direct-current electrolysis method. The anodizing treatment was conducted at 1.5 A/dm$^2$ for 10 minutes in a sulfuric acid bath having a concentration of 200 g/L at 20° C. The film thickness was 17 to 22 μm. The fabricated test piece having an anodic oxide coating having the two-layer structure constituted of the anodic oxide layer formed by the direct-current electrolysis and the anodic oxide layer formed by the AC-DC superimposition electrolysis was employed as a test piece of Test Example 3.

Test Example 4

A test piece prepared from an aluminum alloy (AC8A) was used as an aluminum-based material. This test piece was immersed in a sulfuric acid bath having a concentration of 200 g/L at 20° C., and first subjected to an AC-DC superimposition electrolysis treatment with 10 kHz and with a positive electrode at 25 V and a negative electrode at −2 V for a treatment time of 2 minutes. After that, in the same sulfuric acid bath, a direct-current electrolysis treatment was conducted with a current density of 1.5 A/dm$^2$ for a treatment time of 10 minutes. The AC-DC superimposition electrolysis treatment and the direct-current electrolysis treatment were alternately conducted three times each to form an anodic oxide coating having six layers in total. The film thickness was 60 to 100 μm. The fabricated test piece having the anodic oxide coating having the six-layer structure constituted of the anodic oxide layers formed by the direct-current electrolysis and the anodic oxide layers formed by the AC-DC superimposition electrolysis was employed as a test piece of Test Example 4.

Evaluation of Density, Hardness, and Surface Roughness

The density (g/cm$^3$), the hardness (Hv), and the surface roughness (Ra) of each of the test pieces of Test Examples 1 to 4 were measured and calculated, and the values were examined. The density (g/cm$^3$) relating to the porosity was measured as follows. Specifically, the density of the aluminum alloy was determined in advance from its weight and volume. Then, the weight of the anodic oxide coating was calculated from the difference between the weight of the test piece on which the coating was formed and the weight corresponding to the thickness of the aluminum alloy, and the density was calculated from the thickness and area of the anodic oxide coating. Note that a higher density indicates a lower porosity. The hardness (Hv) was measured with a Vickers hardness tester. Meanwhile, the surface roughness (Ra) was measured with a surface roughness tester. Table 1 shows the values of the density, the hardness, and the surface roughness of the test pieces of Test Examples 1 to 4. Note that since each of the test pieces of Test Examples 3 and 4 had a structure of two or more layers with different hardness, the hardness was not measured for Test Examples 3 and 4.

TABLE 1

| | Test Ex. 1 | Test Ex. 2 | Test Ex. 3 | Test Ex. 4 |
|---|---|---|---|---|
| Coating | Coating formed by DC electrolysis | Coating formed by AC-DC super-imposition electrolysis | Coating formed by AC-DC super-imposition electrolysis + Coating formed by DC electrolysis | Coatings formed by AC-DC super-imposition electrolysis + Coatings formed by DC electrolysis |
| Layer structure | One layer | One layer | Two layers | Six layers |
| Density (g/cm$^3$) | 1.59 | 2.22 | 1.95 | 2.01 |
| Hardness (Hv) | 366 | 412 | — | — |
| Surface roughness (Ra) | 3.2 | 1.2 | 1.5 | 1.6 |

As shown in Table 1, a comparison between Test Example 1 and Test Example 2 shows that the surface roughness was lower and the density was higher in Test Example 2 than in Test Example 1. From this result, it can be seen that an anodic oxide coating formed by AC-DC superimposition electrolysis has a higher water repellency, a higher oil repellency, and a higher impact resistance and makes a greater contribution to the improvement of heat insulation properties than an anodic oxide coating formed by direct-current electrolysis. In addition, it can be seen that an anodic oxide coating formed by direct-current electrolysis has higher heat insulation properties than an anodic oxide coating formed by AC-DC superimposition electrolysis.

A comparison between Test Example 1 and Test Example 3 shows that the test piece of Test Example 3 had a lower surface roughness and a higher density than that of Test Example 1. From this result, it can be seen that an anodic oxide coating having a two-layer structure in which an anodic oxide layer formed by AC-DC superimposition electrolysis is the upper layer and an anodic oxide layer formed by direct-current electrolysis is the lower layer has a higher water repellency, a higher oil repellency, and a higher impact resistance than an anodic oxide coating having a single-layer structure of an anodic oxide layer formed by direct-current electrolysis. In addition, it can be seen that an anodic oxide coating having the two-layer structure achieves both high heat insulation properties and a high impact resistance. Regarding these functions, when an anodic oxide coating having the two-layer structure is applied to an internal combustion engine, the anodic oxide coating can be expected to exhibit a high impact resistance sufficient for practical use, and exert an effect of reducing adhering matter before and after combustion and an effect of improving the corrosion resistance.

A comparison between Test Example 1 and Test Example 4 shows that the test piece of Test Example 4 had a lower surface roughness and a higher density than that of Test Example 1. From this result, it can be seen that an anodic oxide coating having the six-layer structure in which anodic oxide layers formed by AC-DC superimposition electrolysis and anodic oxide layers formed by direct-current electrolysis are arranged in an alternate manner, more generally, an anodic oxide coating having three or more layers has a higher water repellency, a higher oil repellency, and a higher impact resistance than an anodic oxide coating having a single-layer structure of an anodic oxide layer formed by direct-current electrolysis. It can be seen that an anodic oxide coating having the six-layer structure, more generally, an anodic oxide coating having three or more layers achieves both high heat insulation properties and a high impact resistance. Regarding these functions, when an anodic oxide coating having a layer structure of three or more layers is applied to an internal combustion engine, the anodic oxide coating can be expected to exhibit a high impact resistance enough for practical use, and exert an effect of reducing attached matters before and after combustion and an effect of improving the corrosion resistance.

Corrosion Resistance Test

As a corrosion resistance test, the salt spray test specified in JIS Z 2371 (International Standard: ISO 9227) was conducted on each of the test pieces of Test Examples 1 to 3 for 1000 hours. After that, the test pieces were dried, and then the degrees of corrosion were compared with one another by visual inspection. Note that the test pieces used for the evaluation of the corrosion resistance were cut out from the test pieces fabricated in Test Examples 1 to 3, and the peripheries thereof were masked. Part (a) of FIG. 4 shows the result of the corrosion resistance test on the test piece of Test Example 1, Part (b) of FIG. 4 shows the result of the corrosion resistance test on the test piece of Test Example 2, and Part (c) of FIG. 4 shows the result of the corrosion resistance test on the test piece of Test Example 3.

Figure 4A:
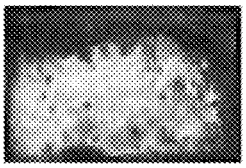
FIG. 4 Parts (a) to (c) of FIG. 4 are photographs showing results of a corrosion resistance test shown in Examples relating to the anodic oxide coating and the treatment method therefor according to the present invention.
Figure 4B:
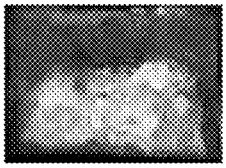
Figure 4C:
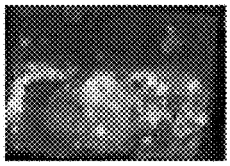

As shown in Parts (a) and (b) of FIG. 4, a comparison between Test Example 1 and Test Example 2 shows that the area where the aluminum alloy was exposed or the corrosion occurred was smaller in the test piece of Test Example 2 than in that of Test Example 1. From this result, it was found that the anodic oxide coating formed by the AC-DC superimposition electrolysis had a higher corrosion resistance than the anodic oxide coating formed by the direct-current electrolysis.

As shown in Parts (a) and (c) of FIG. 4, a comparison between Test Example 1 and Test Example 3 shows that the area where the aluminum alloy was exposed or the corrosion occurred was smaller in the test piece of Test Example 3 than in that of Test Example 1. From this result, it was found that the test piece of Test Example 3 having the anodic oxide coating having the two-layer structure in which the anodic oxide layer formed by the AC-DC superimposition electrolysis was the upper layer and the anodic oxide layer formed by the direct-current electrolysis was the lower layer had a higher corrosion resistance than the anodic oxide coating having the single-layer structure formed by the AC-DC superimposition electrolysis.

As shown in Parts (b) and (c) of FIG. 4, a comparison between Test Example 2 and Test Example 3 shows that the area where the aluminum alloy was exposed or the corrosion occurred was smaller in the test piece of Test Example 3 than in that of Test Example 2. From this result, it was found that the test piece of Test Example 3 having the anodic oxide coating in which the anodic oxide layer formed by the AC-DC superimposition electrolysis was the upper layer and the anodic oxide layer formed by the direct-current electrolysis was the lower layer had a higher corrosion resistance than the single-layer anodic oxide coating formed by the AC-DC superimposition electrolysis.

Figure 5:
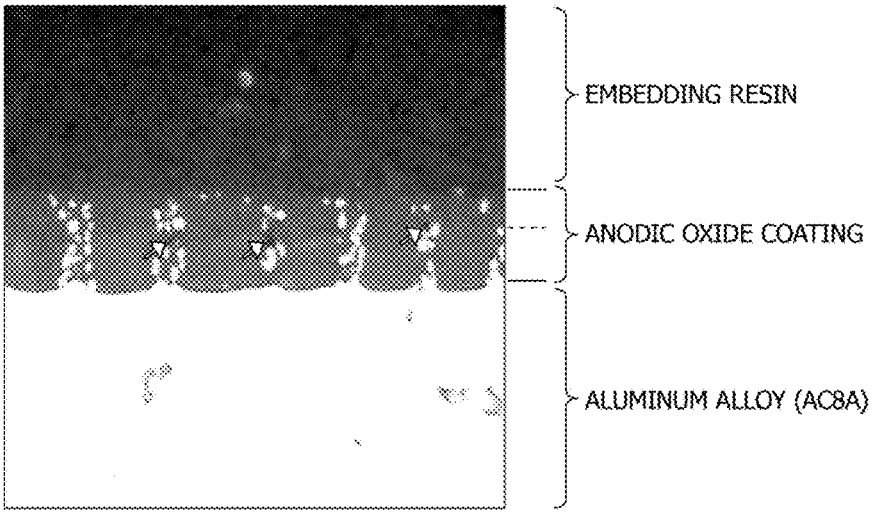
FIG. 5 is a cross-sectional photograph showing a result of an example of the anodic oxide coating and the treatment method therefor according to the present invention.

FIG. 5 is a cross-sectional photograph of the test piece formed in Test Example 3 taken by using an optical microscope after the corrosion resistance test was conducted. In FIG. 5, the layer in the anodic coating above the dashed line on the paper represents the coating formed by the AC-DC superimposition electrolysis, the layer below the dashed line on the paper represents the coating formed by the direct-current electrolysis, and major pore portions in the anodic oxide coating are indicated by using the arrows.

As shown in FIG. 5, in the test piece fabricated in Test Example 3, the second anodic oxide layer by the AC-DC superimposition electrolysis treatment was formed as the upper layer in the anodic oxide layer, and the first anodic oxide layer by the direct-current electrolysis treatment was formed as the lower layer in the anodic oxide layer. In other words, it was confirmed that an anodic oxide coating having a two-layer structure was formed in the test piece of Test Example 3. In addition, it was confirmed that the anodic oxide coating having the two-layer structure was formed on the aluminum alloy.

In the anodic oxide layer formed by the direct-current electrolysis and serving as the lower layer, pores were formed in portions where the presence of silicon inhibited the formation of the coating, and hence the coating was not formed. Micro-level pores were present in the coating obtained by the direct-current electrolysis treatment and serving as the lower layer, and no pores were present in the coating obtained by the AC-DC superimposition electrolysis treatment and serving as the upper layer. It was also found that no micro-level pores were observed around the silicon in the coating, and the coating surely covered the vicinity of the silicon.

Figure 6A:
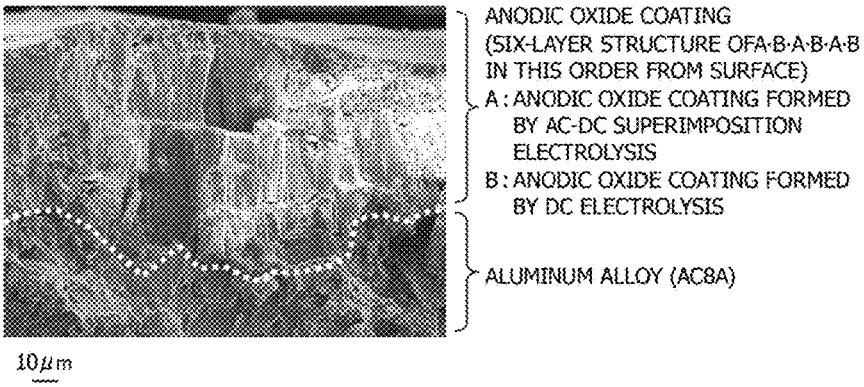
FIG. 6 Parts (a) and (b) of FIG. 6 are cross-sectional photographs showing results of an example of the anodic oxide coating and the treatment method therefor according to the present invention.
Figure 6B:
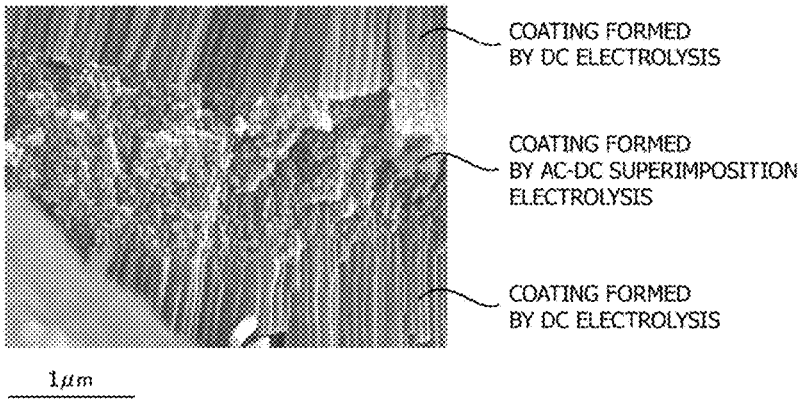

Part (a) of FIG. 6 shows a photograph of a fracture surface of the coating of Test Example 4, and Part (b) of FIG. 6 shows a partial enlarged photograph of the coating. It was found that neither cracks nor gaps were observed between the coating with a high porosity constituted of the gathering of cylindrical cells (with hollow insides) and formed by the direct-current electrolysis treatment, and the coating constituted of dense cells and formed by the AC-DC superimposition electrolysis treatment. Accordingly, it was found that the coatings were firmly joined to each other. It can be seen that the test piece of Test Example 4 had a higher density than that of Test Example 1 as in the case of the test piece of Test Example 3 having the two-layer structure, and that the test piece of Test Example 4 had improved corrosion resistance, improved oil resistance, improved wear resistance, and improved impact resistance, while retaining the high porosity.

From the above-described results, in a multilayer structure having three or more layers, especially a multilayer structure having six layers, a force, such as an impact, applied from the outside to an anodic oxide coating is inhibited from proceeding in the direction toward the aluminum alloy by the second anodic oxide coatings formed by the AC-DC superimposition electrolysis treatment and having a hard and dense structure. Moreover, the above-described force transmitted is further relaxed by the underlying soft first anodic oxide coatings formed by the direct-current electrolysis treatment and having a shape like cylindrical tubes having air layers. In other words, the greater the number of layers in the multilayer structure, the more the force applied to the anodic oxide coating is reduced, before reaching the surface of the aluminum alloy. It has been found that this dramatically improves the impact resistance of the anodic oxide coating. In addition, the greater the number of layers in the multilayer structure of the anodic oxide coating, the more complex the fine structure of the anodic oxide coating is. Hence, it has been found that the corrosion resistance and the oil resistance can be enhanced by increasing the layers in the multilayer structure.

INDUSTRIAL APPLICABILITY

The anodic oxide coating and the treatment method for an anodic oxide coating according to the present invention makes it possible to obtain an anodic oxide coating for an aluminum-based material, a treatment method therefor, and a piston for an internal combustion engine, the anodic oxide coating having both high heat insulation properties and high corrosion resistance, high durability and high impact resistance, and high water-repellent and oil-repellent functions.

REFERENCE SIGNS LIST

1: aluminum-based material; 2, 20: anodic oxide coating; 2*a*: first anodic oxide coating (anodic oxide layer formed by direct-current electrolysis); 2*b*: second anodic oxide coating (anodic oxide layer formed by AC-DC superimposition electrolysis); 2*c*: additional layer; 5: silicon; 10: anodizing treatment apparatus; 11: electrolytic tank; 12: anode; 13: a pair of cathodes; 14: lead wire; 15: power source

The invention claimed is:

1. An anodic oxide coating, comprising at least:

a first anodic oxide coating on a surface of an aluminum-based material;

a second anodic oxide coating on a surface of the first anodic oxide coating; and an additional layer including at least one anodic oxide coatings and provided between the aluminum-based material and the first and second anodic oxide coatings, wherein the first anodic oxide coating is between the aluminum-based material and the second anodic oxide coating, wherein the first anodic oxide coating has more pores therein than the second anodic oxide coating, wherein the second anodic oxide coating has a random orientation by applying AC-DC superimposition electrolysis, and wherein the anodic oxide coatings of the additional layer include an anodic oxide coating which is the same as the first anodic oxide coating and an anodic oxide coating which is the same as the second anodic oxide coating formed in an alternate manner.

2. The anodic oxide coating according to claim 1, wherein the first anodic oxide coating is obtained by application of direct-current electrolysis.

3. A piston for an internal combustion engine, comprising the anodic oxide coating according to claim 1.

4. The anodic oxide coating according to claim 1, wherein the second anodic oxide coating is an outermost surface of the anodic oxide coating.

5. The anodic oxide coating according to claim 1, wherein the first anodic oxide coating has a regular orientation by applying direct current electrolysis.

6. The anodic oxide coating according to claim 1, wherein the first anodic oxide coating is in direct contact with the surface of the aluminum-based material.

7. The anodic oxide coating according to claim 1, wherein the second anodic oxide coating has a greater density than the first anodic oxide coating.

8. The anodic oxide coating according to claim 1, wherein the second anodic oxide coating has smaller pores than the first anodic oxide coating.

9. The anodic oxide coating according to claim 1, wherein the second anodic oxide coating comprises a plurality of pores, and wherein at least a portion of the plurality of pores of the second anodic oxide coating extend only partially through the second anodic oxide coating between a first surface and a second surface of the second anodic oxide coating.

10. The anodic oxide coating according to claim 1, wherein the second anodic oxide coating comprises a plurality of pores, and wherein at least a portion of the plurality of pores of the second anodic oxide coating comprise multiple branches.

* * * * *